US006848630B2

(12) United States Patent
Boecking

(10) Patent No.: US 6,848,630 B2
(45) Date of Patent: Feb. 1, 2005

(54) STROKE AND PRESSURE-CONTROLLED INJECTOR WITH DOUBLE SLIDE

(75) Inventor: Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 152 days.

(21) Appl. No.: 10/169,123

(22) PCT Filed: Sep. 21, 2001

(86) PCT No.: PCT/DE01/03658

§ 371 (c)(1),
(2), (4) Date: Oct. 18, 2002

(87) PCT Pub. No.: WO02/36958

PCT Pub. Date: May 10, 2002

(65) Prior Publication Data

US 2003/0089792 A1 May 15, 2003

(30) Foreign Application Priority Data

Oct. 31, 2000 (DE) ..... 100 53 903

(51) Int. Cl.[7] ..... F02M 41/16; F02M 59/00; F02M 61/00; F02M 63/00; F02M 39/00

(52) U.S. Cl. ..... 239/96; 239/533.2; 239/533.3

(58) Field of Search ..... 239/96, 533.2, 239/533.3, 88–93, 533.8, 533.11, 585.1–585.5; 251/48–54; 123/467

(56) References Cited

U.S. PATENT DOCUMENTS 5,979,790 A * 11/1999 Gurich et al. ..... 239/88
6,067,955 A * 5/2000 Boecking ..... 123/299
6,168,087 B1 * 1/2001 Cooke ..... 239/1
6,227,459 B1 * 5/2001 Coldren et al. ..... 239/88

FOREIGN PATENT DOCUMENTS

DE 196 21 583 A 1/1997
DE 199 23 421 A 11/2000
EP 1 036 931 A 9/2000

* cited by examiner

*Primary Examiner*—Darren Gorman
(74) *Attorney, Agent, or Firm*—Ronald E. Greigg

(57) ABSTRACT

An injector for injecting fuel into the combustion chambers of an internal combustion engine includes an injector body which is movable in a housing and whose vertical stroke motion relative to the housing is effected by a control chamber that can be pressure relieved via an actuator. Via the vertical stroke motion of the injector body, the closure or opening of a nozzle inlet line to the injection nozzle takes place. On the injector body, for stroke and/or pressure control of the injector, a first slide and a second slide are embodied, offset from one another.

18 Claims, 1 Drawing Sheet

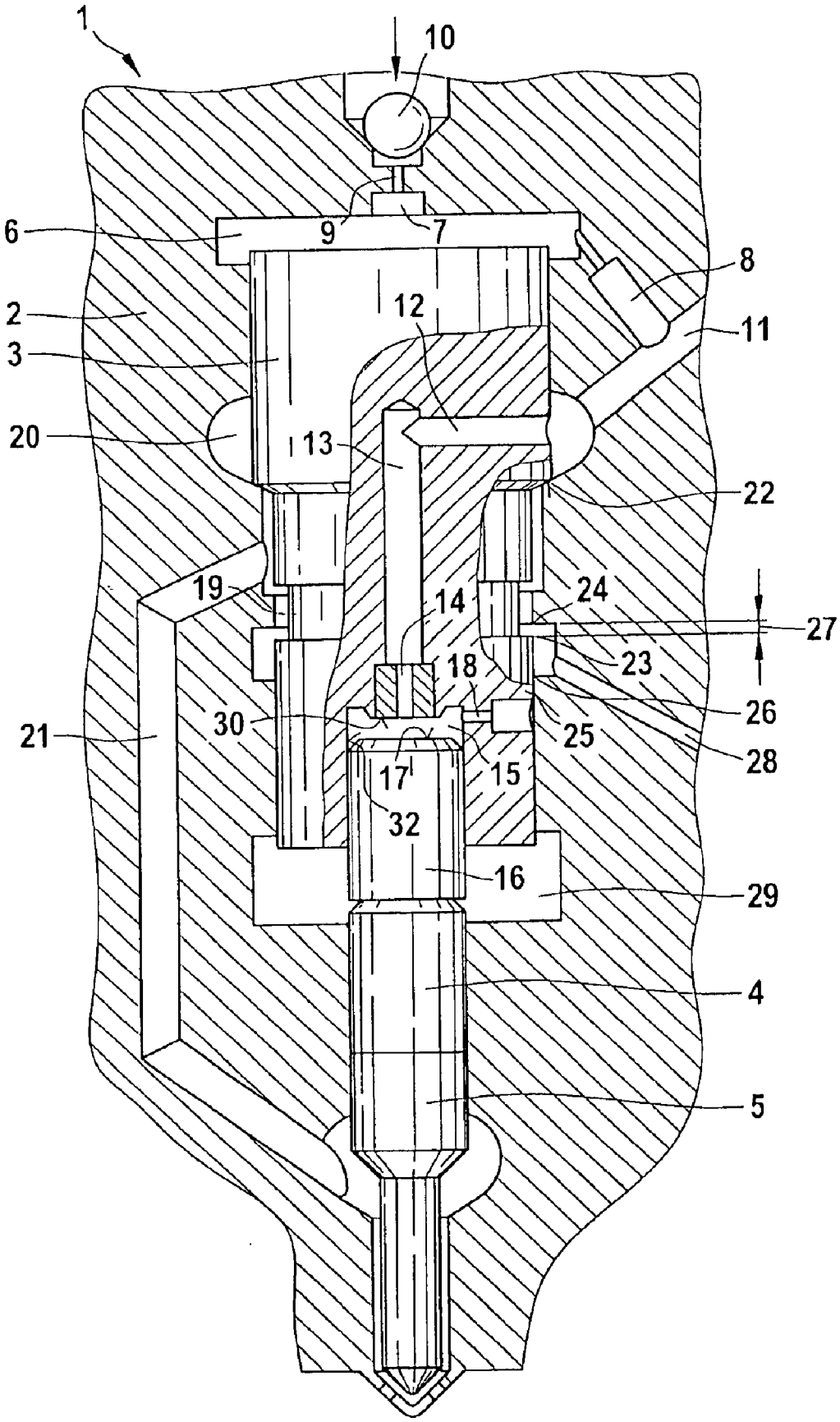
1
10
6
9
7
8
2
12
11
3
20
13
22
19
14
24
27
23
18
26
21
30
25
28
17
15
32
16
29
4
5

STROKE AND PRESSURE-CONTROLLED INJECTOR WITH DOUBLE SLIDE

CROSS REFERENCE TO RELATED APPLICATIONS

This application is a 35 U.S.C 371 application of PCT/DE 01/03658, filed on Sep. 21, 2001.

BACKGROUND OF THE INVENTION

In injection systems of direct-injection internal combustion engines, high-pressure storage systems (common rails) are now used. These have the task of storing the fuel at high pressure. Pressure fluctuations that can be caused by the pumping motion and the injection event, for instance, are meant to be damped by the fuel volume contained in the common rail. The fuel is injected into the combustion chambers of the engines by means of injectors. At the injectors, the injection onset and injection quantity are set; the injectors are preferably disposed on the cylinder head of an internal combustion engine.

PRIOR ART

German Patent Disclosure DE 198 35 494 A1 relates to a unit fuel injector. It is used to supply fuel to a combustion chamber of direct-injection internal combustion engines, with a pump unit for building up an injection pressure. For injecting the fuel into the combustion chamber, injection nozzles are provided. The system further includes a control unit with a control valve, which is embodied as an outward-opening valve. A valve actuation unit for controlling the pressure buildup is also included in the pump unit. To create a unit fuel injector that has a control unit and a simple structure and small size and that in particular has a fast response time, it is known from DE 198 35 494 A1 to embody the valve actuation unit as a piezoelectric actuator.

German Patent DE 37 28 817 C2 relates to a fuel injection pump for an internal combustion engine. This pump includes a pressure part for subjecting the fuel to pressure and a nozzle part for injecting the pressurized fuel, as well as a control part disposed between the pressure part and the nozzle part. This control part intersects a fuel supply line, a cylindrical conduit whose center axis is the fuel supply line, that connects the pressure part to the nozzle part. The end of this line is embodied as a control bore, which changes over into an opening communicating with a fuel return conduit. A control valve member is provided in the conduit and is movable by means of an electrical actuating device between an open position, in which the fuel supply line and the fuel return conduit communicate via the control bore, and a closing position, in which the control bore is closed. The actuating device includes an adjustable-length piezoelectric element, which is connected to a drive piston whose free control face is located opposite a considerably smaller control face of a drive tappet that mechanically adjusts the control valve member, the faces being separated by a hollow space filled with incompressible fuel. A passage connecting the hollow space with the fuel return conduit is embodied in the drive tappet and a check valve is seated in it. This check valve closes the passage when the pressure in the hollow space exceeds the pressure in the fuel return conduit, and it opens the passage when the pressure in the hollow space is less than the pressure in the fuel return conduit.

SUMMARY OF THE INVENTION

With the embodiment proposed according to the invention, an injector design can advantageously be achieved which enables both stroke control and pressure control of the injector body. This makes it possible to meet the latest performance specifications set by utility vehicle engine manufacturers, which call for injector control by two separate principles in order to enable operating the engine at its optimal operating point at all times.

In the injector proposed according to the invention, by means of the configuration of the 3/2-way valve, the pressure in the nozzle chamber of the injection nozzle can be relieved abruptly via the stroke of the 3/2-way valve. The abrupt relief of the nozzle chamber in this operating state causes a pressure control of the injector. When the valve body in the injector housing is opened, the abrupt relief of the nozzle chamber takes place when the full stroke path is traversed; conversely, if the injector is operated at partial pressure, then one slide embodied in the injector body can also be closed while the other slide embodied in the injector body is opened at its control edge and thus allows a stroke. The slides are received offset in the injector housing in valve bodies that are vertically movable, so that a transition from stroke control to pressure control and vice versa of the injector can be attained in a simple way, and the vertical position of the injector body relative to the injector housing is defined.

The vertical motion of the injector body in the housing of the injector is effected by a piezoelectric actuator provided on one end of the valve body, or by some other electrical final control element, with which under the influence of the fastest possible response times, closing or opening of the individual slide and control edge combination can be variably achieved. Magnet valves or piezoelectric actuators can advantageously be used as actuators for pressure relief of the control chamber.

BRIEF DESCRIPTION OF THE DRAWINGS

The invention will be described in further detail below with reference to the sole drawing FIGURE which is a fragmentary longitudinal section of an injector through a 3/2-way valve, on whose injector body two slide edges offset vertically from one another are embodied.

DESCRIPTION OF THE PREFERRED EMBODIMENTS

From the view in the sole drawing FIGURE, the longitudinal section through an injector body can be seen, on which two-slide/control edges are embodied.

The injector 1 shown in the view of FIG. 1 for injecting fuel that is at high pressure into the combustion chambers of an internal combustion engine is a component of an injection system that includes a high-pressure collection chamber (common rail). In the common rail, the fuel is kept an extremely high pressure level by means of a pump, so that the fuel volume present in the pump chamber can be utilized as a damping element for the pressure rinsing operations induced by the pumping motion or the pressure fluctuation induced by the motion of the injector in the line system.

The injector 1 seen in the view in FIG. 1 essentially includes an injector body 3 vertically movable in a housing 2. The injector body 3 in the form of a rotationally symmetrical component is let into a bore of the housing 2. A pressure rod element 4 is disposed on and facing the lower end of the injector body 3, and facing it is a piston 16, which in turn cooperates with a lower control chamber 15 embodied in the injector body 3.

On the top side of the injector body 3, in terms of what FIG. 1 shows, there is a control chamber 6, opposite the upper cylindrical end face of injector body. The control chamber 6 is constantly supplied via a branch 8 with fuel that is at high pressure, thus assuring that an adequate control quantity of fuel is always present in the upper control chamber 6. A throttle element is let into the inlet line 8, which on one end discharges into the upper control chamber 6 and on the other branches off from the common rail inlet. The upper control chamber 6 can be pressure relieved via a relief opening 7, which is adjoined by an outlet throttle 9. The pressure relief of the upper control chamber 6 and thus the inducement of the vertical up- and-down motion of the injector body 3 in the injector housing 2 is effected by triggering an actuator element 10, which can be embodied as a magnet valve or as a piezoelectric actuator, for instance, and which controls the pressure on the ball element acting as a closing element. If the ball element functioning as a closing element is pressure relieved, its seat face is uncovered, thus, in accordance with the outlet throttle configuration 9, establishing a fuel volume that flows out of the upper control chamber 6 continuously via the relief opening 7, resulting in a vertical upward motion of the injector body 3 in the housing 2 of the injector 1.

Via the common rail inlet 11, which discharges into an annular chamber 20 extending annularly around the injector body 3, a bore system provided in the interior of the injector body 3 is subjected to fuel that is at high pressure. Via a transverse bore 12, which extends perpendicular to the line of symmetry of the injector body 3 and via a central bore 13 communicating with the transverse bore and extending coaxially to the line of symmetry of the injector body 3, an inlet throttle element 14 located at the end of the central bore 13 is subjected to fuel that is at high pressure. Via the inlet throttle element 14 at the end of the central bore 13 in the injector body 3, a lower control chamber 15 provided in the injector body is subjected to fuel that is at high pressure. The inlet throttle 14 discharges into the upper boundary wall 30 of the lower control chamber 15 , which is bounded on the other side by the piston face 17 of a piston 16 disposed coaxially to the axis of symmetry of the injector body 3. Between the two boundary faces 17 and 30, there is a cylindrical boundary wall 32 of the lower control chamber 15. The piston 16, which executes a vertical motion as a result of pressure imposition on or pressure relief of the lower control chamber 15 , is located with its face opposite the piston face 17 on the pressure rod 4, which is connected mechanically to the injection nozzle, not shown. Thus by imposition of pressure on or pressure relief of the lower control chamber 15 , a motion of the injection nozzle out of its seat, or in other words an opening or closing of the injection nozzle, can be achieved.

While the pressure imposition on the lower control chamber 15 inside the injector body 3 takes place via the line system 11, 12, 13, 14, the pressure relief of the lower control chamber 15 inside the injector body 3 and thus a vertical upward motion of the piston 16 with its piston face 17 into the lower control chamber 15 can be achieved by providing that via the pressure relief of the upper control chamber 6, a vertical upward motion is impressed upon the injector body 3 as a whole. The lower control chamber 15 is pressure-relievable by means of an outlet throttle 18 discharging into its cylinder wall 32 and by means of an adjoining bore upon an appropriate upward motion of the injector body 3 via a pressure relief line 28 or leak fuel line, so that in upward motions of the piston 16 with its piston face 17 into the lower control chamber 15, upon the pressure relief thereof, an opening of the nozzle needle of the injection nozzle 5 away from its seat is attainable.

A nozzle inlet line 21, which is designed to be proof against high pressure, is also received in the housing 2 of the injector 1, and by way of it the injection nozzle , indicated in the drawing by the arrow 5, can be subjected to fuel that is at high pressure. In the drawing shown in FIG. 1, the injector body 3 is in a position in which the nozzle inlet line 21 is closed on the high-pressure side by the contact of a seat face 22 of the injector body 3 of the housing 2; that is, the fuel volume that is at high pressure and is contained in the annular chamber 20 does contact the lower control chamber 15 via the bores 12, 13, 14 and thereby closes the nozzle; on the other hand, in the nozzle chamber of the injection nozzle 5, there is no fuel at high pressure, since the sealing seat 22 disconnects the nozzle inlet 21 from the common rail inlet in the housing.

Triggering of the electric actuator 10 causes a pressure relief of the upper control chamber 6. As a result, the cylindrical end face of the injector body 3 moves into the upper control chamber, establishing a vertical upward motion of the injector body 3 in the housing 2 of the injector 1. Depending on how large a control volume has escaped from the upper control chamber 6 via the relief opening 7 and the adjoining outlet throttle 9, a first slide 23 of the injector body 3, which is connected to the main portion of injector body 3 by a narrowed section 19, overtakes a first control edge 24 embodied in the housing. As a result, upon opening of the sealing face 22 and thus the imposition of pressure on the nozzle inlet line 21 to the injection nozzle 5, it is assured that no fuel that is at high pressure can directly enter an outlet line 28; that is, the injector is closed on the leak fuel side. In this partial-stroke mode, it must be assured that the control volume that has escaped from the upper control chamber 6 imposes a stroke path 27 on the injector body 3 that is precisely the right length to cause the control edge 24 of the housing and the slide edge 23 provided in the injector body to coincide.

In a further, more-extensive pressure relief of the upper control chamber 6 by opening the relief opening 7 or triggering the electric actuator 10, a further upward motion of the injector body 3 is possible. This causes the opening of the second slide 25, after it has passed the control edge 26 provided in the housing. Once the second slide has opened, a pressure relief of the lower control chamber 15 ensues through the outlet throttle 18 into the annular chamber which surrounds the injector body 3 and contains an outlet line 28. By the opening of the second slide upon opening of the valve body 3, that is, the generation of the full vertical stroke motion of the injector body 3 in the housing 2 surrounding it, an abrupt pressure relief of the lower control chamber 15 is possible, causing the piston 16 to move with its piston face 17 into the control chamber. In this operating state, the nozzle needle of the injection nozzle 5 opens at its seat face, so that the fuel volume that is at high pressure in the nozzle inlet line 21—the seat face 22 of the injector body 3 being open—can be injected.

In this state, the injector is pressure-controlled while in the partial-stroke mode, that is, the generation of solely an upward motion of the injector body 3 that is equivalent to the stroke path 27, the injector is stroke-controlled.

Reference numeral 29 indicates a leak fuel chamber, in which fuel from the lower control chamber 15 flowing along the piston 16 collects. This fuel, along with the control volume flowing out of the upper control chamber 6 via the relief line 7, and the control volume flowing out of the lower control chamber 15 provided in the injector body 3 via the outlet throttle 18 and the outlet line 28, is returned to the fuel tank again.

For the sake of completeness, it should be noted that for the sake of strength and to assure durable function of the injector configuration of the invention, both the common rail inlet 11 to the annular chamber 20 and the branch 18 to the upper control chamber 6 as well as the nozzle inlet 21 in the housing 2 of the injector 1 are designed as bores, and the housing is manufactured from high-strength metal material. The same is true for the injector body 3 that is movable up and down in the housing 2 of the injector 1.

The foregoing relates to the preferred exemplary embodiments of the invention, it being understood that other variants and embodiments thereof are possible within the spirit and scope of the invention, the latter being defined by the appended claims.

I claim:

1. An injector for injecting fuel into the combustion chamber of an internal combustion engine, comprising, an injector body (3), which is movable in a housing (2) and whose vertical stroke motion relative to the housing (2) is effected via an upper control chamber (6) that can be pressure-relieved by means of an actuator (10), and the closure or opening of a nozzle inlet line (21) to an injection nozzle (5) is effected via the vertical stroke motion of the injector body, and, a first slide (23) and a further slide (25) embodied on the injector body (3) for the stroke and/or pressure control of the injector, wherein a partial stroke path (27) for closing the first slide (23) is shorter than the stroke path required for opening the further slide (25), for pressure relief of a lower control chamber (15) in the injector body (3).

2. The injector of claim 1 wherein the lower control chamber (15) can be acted upon via the high-pressure inlet (11), the lower control chamber (15) being embodied in the injector body (3) and can be pressure-relieved via an outlet throttle (18).

3. The injector of claim 1 wherein the injection nozzle (5) is mechanically connected to the lower control chamber (15) by a piston/pressure rod arrangement (4), (16) and upon pressure relief of the lower control chamber (15) the injection nozzle (5) opens.

4. The injector of claim 1 further comprising control edges (24,26) in the housing, the slides (23), (25) cooperating with control edges (24), (26).

5. The injector of claim 4 wherein the control edges (24), (26) embodied on the housing (2) of the injector (1) discharge into a pressure relief line (28).

6. The injector of claim 1 wherein the upper control chamber (6) that controls the vertical stroke motion of the injector body (3) can be acted upon via a branch (8) from a common rail inlet (11) and can be pressure relieved via the actuator (10) preceded by an outlet throttle element.

7. An injector for injecting fuel into the combustion chamber of an internal combustion engine, comprising, an injector body (3), which is movable in a housing (2) and whose vertical stroke motion relative to the housing (2) is effected via an upper control chamber (6) that can be pressure-relieved by means of an actuator (10), and the closure or opening of a nozzle inlet line (21) to an injection nozzle (5) is effected via the vertical stroke motion of the injector body, and, a first slide (23) and a further slide (25) embodied on the injector body (3) for the stroke and/or pressure control of the injector, wherein the injector body (3) includes a bore system (12), (13) and an inlet throttle (14), by means of which a lower control chamber (15) is in communication with a high pressure source.

8. The injector of claim 7 wherein the lower control chamber (15) can be acted upon via a high-pressure inlet (11), the lower control chamber (15) being embodied in the injector body (3) and can be pressure-relieved via an outlet throttle (18).

9. The injector of claim 7 wherein the injection nozzle (5) is mechanically connected to the lower control chamber (15) by a piston/pressure rod arrangement (4), (16) and upon pressure relief of the lower control chamber (15) the injection nozzle (5) opens.

10. The injector of claim 7 further comprising control edges (24,26) in the housing, the slides (23), (25) cooperating with control edges (24), (26).

11. The injector of claim 10 wherein the control edges (24), (26) embodied on the housing (2) of the injector (1) discharge into a pressure relief line (28).

12. The injector of claim 7 wherein the upper control chamber (6) that controls the vertical stroke motion of the injector body (3) can be acted upon via a branch (8) from a common rail inlet (11) and can be pressure relieved via the actuator (10) preceded by an outlet throttle element.

13. An injector for injecting fuel into the combustion chamber of an internal combustion engine, comprising, an injector body (3), which is movable in a housing (2) and whose vertical stroke motion relative to the housing (2) is effected via an upper control chamber (6) that can be pressure-relieved by means of an actuator (10), and the closure or opening of a nozzle inlet line (21) to an injection nozzle (5) is effected via the vertical stroke motion of the injector body, and, a first slide (23) and a further slide (25) embodied on the injector body (3) for the stroke and/or pressure control of the injector, wherein a partial stroke path (27) for closing the first slide (23) is shorter than the stroke path required for opening the further slide (25), for pressure relief of a lower control chamber (15) in the injector body (3), and wherein, upon opening of a seat face (22) of a valve chamber (20) in the housing (2) of the injector (1), the nozzle inlet line (21) is subjected to high pressure, and simultaneously the first slide (23), (24) is closed and the opening of the injection nozzle (5) takes place by pressure relief of the lower control chamber (15), via an opening of the slide (25) and edge (26) into an outlet line (28).

14. The injector of claim 13 wherein the lower control chamber (15) can be acted upon via a high-pressure inlet (11), the lower control chamber (15) being embodied in the injector body (3) and can be pressure-relieved via an outlet throttle (18).

15. The injector of claim 13 wherein the injection nozzle (5) is mechanically connected to the lower control chamber (15) by a piston/pressure rod arrangement (4), (16) and upon pressure relief of the lower control chamber (15) the injection nozzle (5) opens.

16. The injector of claim 13 further comprising control edges (24,26) in the housing, the slides (23), (25) cooperating with control edges (24), (26).

17. The injector of claim 16 wherein the control edges (24), (26) embodied on the housing (2) of the injector (1) discharge into a pressure relief line (28).

18. The injector of claim 13 wherein the upper control chamber (6) that controls the vertical stroke motion of the injector body (3) can be acted upon via a branch (8) from a common rail inlet (11) and can be pressure relieved via the actuator (10) preceded by an outlet throttle element.

* * * * *